US008707633B2

(12) United States Patent
Han et al.

(10) Patent No.: US 8,707,633 B2
(45) Date of Patent: Apr. 29, 2014

(54) FIELD EMERGENCY SHELTER FOR FAST MINIMALLY INVASIVE CARDIOVASCULAR SURGERY

(75) Inventors: Yaling Han, Shenyang (CN); Weihong Meng, Shenyang (CN); Bing Chen, Shenyang (CN); Jingyang Sun, Shenyang (CN); Shulin Tan, Shenyang (CN); Tianming Yao, Shenyang (CN); Yanchun Liang, Shenyang (CN); Geng Wang, Shenyang (CN); Jie Deng, Shenyang (CN); Fei Li, Shenyang (CN); Yi Li, Shenyang (CN); Xiuguo Zhao, Shenyang (CN)

(73) Assignee: The General Hospital of Shenyang Military Region of the Chinese People's Liberation Army, Shenyang, Liaoning (CN)

( * ) Notice: Subject to any disclaimer, the term of this patent is extended or adjusted under 35 U.S.C. 154(b) by 74 days.

(21) Appl. No.: 13/379,484

(22) PCT Filed: Feb. 22, 2011

(86) PCT No.: PCT/CN2011/071173

§ 371 (c)(1),
(2), (4) Date: Dec. 20, 2011

(87) PCT Pub. No.: WO2012/037794

PCT Pub. Date: Mar. 29, 2012

(65) Prior Publication Data

US 2012/0265005 A1 Oct. 18, 2012

(30) Foreign Application Priority Data

Sep. 21, 2010 (CN) ..... 2010 1 0289007

(51) Int. Cl.
*E04H 1/00* (2006.01)

(52) U.S. Cl.
USPC ..... 52/79.5; 52/79.1

(58) Field of Classification Search
USPC ..... 52/64, 79.1, 79.4–79.9
See application file for complete search history.

(56) References Cited

U.S. PATENT DOCUMENTS 4,915,435 A * 4/1990 Levine ..... 296/24.38
5,706,846 A * 1/1998 Sutton ..... 135/128

(Continued)

FOREIGN PATENT DOCUMENTS

CN 2264227 Y 10/1997
CN 2264228 Y 10/1997

(Continued)

*Primary Examiner* — Mark Wendell
(74) *Attorney, Agent, or Firm* — Houtteman Law LLC

(57) ABSTRACT

The present invention relates to a medical emergency care shelter, more specifically, to a field emergency shelter for fast minimally invasive cardiovascular surgery. The field emergency shelter for fast minimally invasive cardiovascular surgery includes a fixed central shelter body 1. The poison filter 6, purifying air conditioner 7, and heating apparatus 8, 9 are installed on the fixed central shelter body 1. A door 12 is installed on the rear wall of the fixed central shelter body 1. The retractable linkages 13 are installed around the door 12. Two extendable shelter bodies are connected to the left and right sides of the fixed central shelter body, respectively. The extendable shelter bodies 2 have an extendable structure. Doors 4 are installed on the side wall of the extend shelter bodies 2. Each of the extendable shelter bodies 2 has hydraulic cylinder 3 and an extendable unit. The working end of the hydraulic cylinder 3 is connected to one end of the foldable unit.

3 Claims, 3 Drawing Sheets

(56) References Cited

U.S. PATENT DOCUMENTS

| | | | | |
|---|---|---|---|---|
| 5,775,758 | A * | 7/1998 | Eberspacher | 296/24.38 |
| 6,082,799 | A * | 7/2000 | Marek | 296/24.38 |
| 6,179,358 | B1 * | 1/2001 | Hirayama et al. | 296/24.38 |
| 7,347,472 | B2 * | 3/2008 | Pellegrin, Jr. | 296/24.38 |
| 7,794,001 | B2 * | 9/2010 | Blackwell et al. | 296/24.38 |
| 2006/0113251 | A1 * | 6/2006 | McGuire et al. | 210/652 |
| 2007/0102946 | A1 * | 5/2007 | Blackwell et al. | 296/24.38 |
| 2009/0217930 | A1 * | 9/2009 | Holley et al. | 128/205.26 |
| 2013/0031845 | A1 * | 2/2013 | Ali | 52/79.1 |

FOREIGN PATENT DOCUMENTS

| | | |
|---|---|---|
| CN | 101822595 | 9/2010 |
| WO | WO2008001395 A1 | 1/2008 |

* cited by examiner

FIELD EMERGENCY SHELTER FOR FAST MINIMALLY INVASIVE CARDIOVASCULAR SURGERY

FIELD OF THE INVENTION

The present invention relates to a medical emergency care shelter, more specifically, to a field emergency shelter for fast minimally invasive cardiovascular surgery. The present invention is used for fast diagnosis and treatment of acute cardiovascular diseases, external damage to the heart, blood vessel damage, as well as fast 3D locating of bullet position inside the body during a war or other military actions.

BACKGROUND OF THE INVENTION

When in war or other military actions, human body is in a state of extreme stress, which significantly increases the incidence of acute and serious cardiovascular diseases for military personnel, especially high-level commanders. At present, the most effective method for treating acute myocardial infarction is PCI, which is used to open the coronary quickly. This method could reduce the death rate by 70%-80%, compared to traditional medical method. However, C-Arm vessel imaging machine and other related machines are needed in order to open the coronary, and experienced medical experts are needed for the surgery. At present, the traditional way to deal with this kind of situation is to transport the patient to a large cardiovascular medical center. However, statistics show that about 50% of acute myocardial infarction patients died on the way to the medical center. How to promptly take care of patients to decrease the death rate or disability rate has been a hot topic in the field of cardiovascular care. The current solution is to bring experienced doctors to hospitals that have PCI equipment but do not have experienced doctors. Research shows that this method can reduce the time for transferring a patient to the hospital, and significantly reduce the possibility of a heart attack within 30 days (8.9% compared with 17.2%). However, this method is hard to implement because during a war or other military actions, the battlefield usually is far away from hospitals or large medical centers that have a C-Arm vessel imaging machine and other needed equipment.

If a C-Aim vessel imaging machine and other cardiovascular care machines and medical care experts can be integrated and transferred to the battle field, then cardiovascular diseases can be diagnosed earlier, treated more promptly during a war or other military actions. There are no prior references disclosing anything about such a method.

SUMMARY OF THE INVENTION

The objective of the present invention is to provide a field emergency shelter for fast and minimally invasive cardiovascular surgery, which has a simple structure and high adaptability, and can be easily and rapidly opened. Thus, medical experts can provide prompt treatment to patients who have cardiovascular diseases.

Example embodiments of the present invention provide a field emergency shelter for fast minimally invasive cardiovascular surgery having a fixed central shelter body. Poison filters, purifying air conditioners, and heating apparatus are installed on the fixed central shelter body. A door is installed on a side wall of the fixed central shelter body.

In an example embodiment of the present invention, retractable linkages are installed around the door.

In an example embodiment of the present invention, the fixed central shelter body further connects to two extendable shelter bodies. The two extendable shelter bodies have an extendable structure. Doors are installed on the side wall of each of the two extendable shelter bodies.

In an example embodiment of the present invention, the two extendable shelter bodies have a hydraulic cylinder and an extendable unit. The working end of the hydraulic cylinder connects to one end of the extendable unit.

In an example embodiment of the present invention, an apparatus box, a movable infusion support, an electric power distribution box, an oxygen cylinder, an instrument table holder, a C-arm X ray apparatus, a monitor and an operating bed may be installed in the fixed central shelter body.

In another example embodiment of the present invention, a washbowl, a uniform hanger, a high pressure syringe, an intra-aortic balloon pump, an oxygen generator, a small instrument table, a large instrument table, a constriction device, an invasive blood pressure monitor, and a defibrillator monitor may be installed in the two extendable shelter bodies.

In another example embodiment of the present invention, instrument boxes are installed in the fixed shelter body close to the two sides of the C-arm X ray apparatus, respectively.

In another example embodiment of the present invention, an instrument box and a high-pressure syringe box are installed in the fixed shelter body close to the rear side of the C-arm X ray apparatus.

In another example embodiment of the present invention, a sun-proof rack is installed on the roof of the fixed central shelter body.

In another example embodiment of the present invention, the instrument box contains a medical tube, constriction devices, invasive blood pressure monitors, defibrillator monitors, a portable ultrasound device, an electrocardiograph, and a lead cloth.

The instruments and equipment according to example embodiments of the present invention have a simple structure and high adaptability, and can be easily and rapidly opened.

A field emergency shelter according to example embodiments of the present invention may work with a battle field medical care support system through its retractable linkage. The field emergency shelter may be connected to shelters of a battle filed medical care support system through the retractable linkage and thus become a unit of the battle field medical care support system.

DETAILED DESCRIPTION OF THE PREFERRED EMBODIMENTS

Figure 1:
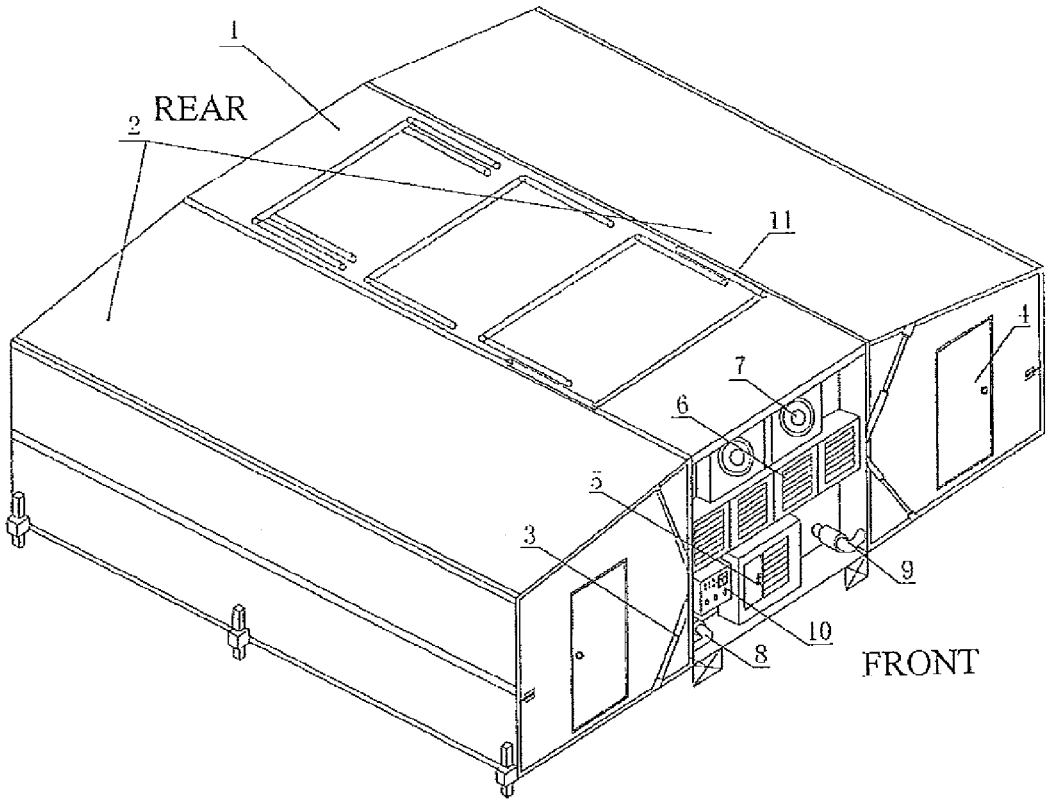
FIG. 1 is schematic view of a field emergency shelter when in working status according to an example embodiment of the present invention.

As shown in the figures, a field emergency shelter for fast minimally invasive cardiovascular surgery includes a fixed central shelter body and two extendable four-board-linkage shelter bodies connected to the left and right sides of the fixed central shelter body, respectively. The fixed central shelter body has a front wall and a rear wall with embedded lead boards. Heating apparatus, poison filters and purifying air conditioners, and a hydraulic station are installed on the outside of the front wall of the fixed central shelter body. A door is installed in the middle of the rear wall of the fixed central shelter body. A door is installed on the front wall of each of the two extendable four-board-linkage shelter bodies. Four hydraulic cylinders are installed on the outside of the front wall and the rear wall of the fixed central shelter body, and connect to the two extendable four-board-linkage shelter bodies, respectively. Lamps, cameras, moveable infusion support are installed on the ceiling of the fixed central shelter body. An oxygen cylinder and an electric power distribution box are installed on the rear wall inside the fixed central shelter body. In the fixed central shelter body are also installed a medium-sized high-frequency movable C-arm X ray apparatus and an electric hydraulic bone surgery operating bed, and an apparatus control box. The apparatus control box is disposed between the front wall and the medium-sized high-frequency movable C-arm X ray apparatus. A washbowl and uniform hangers are installed on the rear part of the extendable four-board-linkage shelter body connected to the left side of the fixed shelter body. High pressure syringes and intra-aortic balloon pumps are installed in the fixed central shelter body. The fixed central shelter body has an apparatus box and an instrument box. A large foldable instrument table and a small instrument table are installed on the right wall in the fixed central shelter body. The present invention can be used as a unit of a battle field medical care support system.

In example embodiments of the present invention, the two extendable four-board-linkage shelter bodies connected to the left and right sides of the fixed central shelter body can be extended and thus the field emergency shelter for fast minimally invasive cardiovascular surgery is in a working status. The two extendable four-board-linkage shelter bodies connected to the left and right sides of the fixed central shelter body can be retracted and thus the field emergency shelter for fast minimally invasive cardiovascular surgery is back to the normal status or transportation status.

In example embodiments of the present invention, the medium-sized high-frequency movable C-arm X ray apparatus is installed in the middle of the fixed central shelter body, and the electric hydraulic bone surgery operating bed is installed on the rear right part of the medium-sized high-frequency movable C-arm X ray apparatus. When the field emergency shelter for fast minimally invasive cardiovascular surgery is in normal status, or transportation status, the long side of the electric hydraulic bone surgery operating bed is rotated towards the bottom portion of the medium-sized high-frequency movable C-arm X ray apparatus. When the field emergency shelter for fast minimally invasive cardiovascular surgery is in the working status, the electric hydraulic bone surgery operating bed is rotated 90 degree, the long side of the electric hydraulic bone surgery operating bed is thus perpendicular to the bottom portion of the medium-sized high-frequency movable C-arm X ray apparatus. Thus, the bed can enter into the C arms of the medium-sized high-frequency movable C-arm X ray apparatus.

In example embodiments of the present invention, the computer for controlling the medium-sized high-frequency movable C-arm X ray apparatus, UPS power supply and batteries are installed in the apparatus control box.

In example embodiments of the present invention, when the field emergency shelter for fast minimally invasive cardiovascular surgery is in the working status, the instrument box will be taken out and placed outside of the fixed central shelter body.

In the example embodiments of the present invention, the high-pressure syringes and intra-aortic balloon pumps are disposed on one side of the fixed central shelter body.

In example embodiments of the present invention, the foldable large instrument table and the small instrument table will be unfolded and be disposed on a predetermined position in the fixed shelter body, when the field emergency shelter for fast minimally invasive cardiovascular surgery is in working status. All the instruments for the surgery are put on the instrument tables.

A field emergency shelter for fast minimally invasive cardiovascular surgery according to example embodiments of the present invention can be connected to a non-extendable shelter of a battle medical care support system when working with the non-extendable shelter of a battle medical care support system, and thus become a unit of the battle field medical care support system.

As shown in FIG. 1, the field emergency shelter for fast minimally invasive cardiovascular surgery includes a fixed central shelter body 1. The poison filter 6, purifying air conditioner 7, and heating apparatus 8, 9 are installed on the fixed central shelter body 1. A door 12 is installed on the rear wall of the fixed central shelter body 1. The retractable linkages 13 are installed around the door 12.

Two extendable shelter bodies 2 are connected to the left and right sides of the fixed central shelter body, respectively. The extendable shelter bodies 2 have an extendable structure. Doors 4 are installed on the side wall of the extend shelter bodies 2.

Each of the extendable shelter bodies 2 has a hydraulic cylinder 3 and an extendable unit. The working end of the hydraulic cylinder 3 is connected to one end of the foldable unit.

An apparatus box 14, a movable infusion support 25, an electric power distribution box 20, an oxygen cylinder 21, an instrument table holder 19, a C-arm X ray apparatus 15, a monitor 16 and an operating bed 17 are installed in the fixed central shelter body.

A washbowl 22, a uniform hanger 37, a high-pressure syringe 33, an intra-aortic balloon pump 34, an oxygen generator 32, small instrument tables 31 and 18, a large instrument table 30, a constriction device 26, an invasive blood pressure monitor 27, and a defibrillator monitor 28 are installed in the extendable shelter bodies 2.

Instrument boxes 39 are installed in the fixed shelter body 1 close to the two sides of the C-arm X ray apparatus 15, respectively.

An instrument box 41 and a high-pressure syringe box 42 are installed in the fixed shelter body close to the rear side of the C-arm X ray apparatus 15.

A sun-proof rack 11 is installed on the roof of the fixed shelter body 1.

The instrument box 41 contains a medical tube 45, constriction devices 46 and 26, invasive blood pressure monitor 47 and 27, defibrillator monitors 48 and 28, a portable ultrasound device 49, an electrocardiographs 50, and lead cloth 51.

As shown in FIG. 1, the extendable shelter bodies 2 may be a four-board-linkage shelter body connected to the two sides of the fixed central shelter body 1. Hydraulic cylinders 3 are installed on the outside of the front wall and the rear wall, respectively. A hydraulic station 5, a poison filter 6, a purifying air conditioner 7, heating apparatus 8 and 9, power control box and signal transmission box 10 are also installed on the outside of the front wall of the fixed central shelter body 1.

Doors 4 are installed on the front wall of each of the extendable shelter bodies 2 connected to the two sides of the fixed central shelter body 1. On the roof of the fixed central shelter body is installed a sun-proof rack 11.

Figure 2:
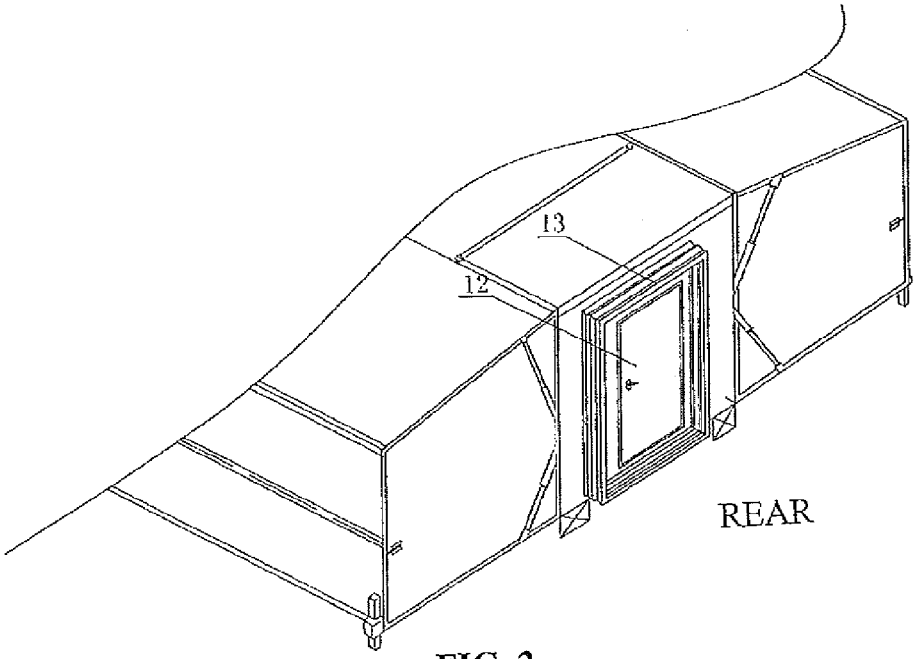
FIG. 2 is schematic view of the rear side of the field emergency shelter when in working status according to an example embodiment of the present invention.

As shown in FIG. 2, a door 12 is installed on the middle of the rear wall of the fixed central shelter body. Retractable linkages 13 are installed around the door 12 to connect the fixed central shelter body to a battle field medical care support system when it is necessary.

Figure 3:
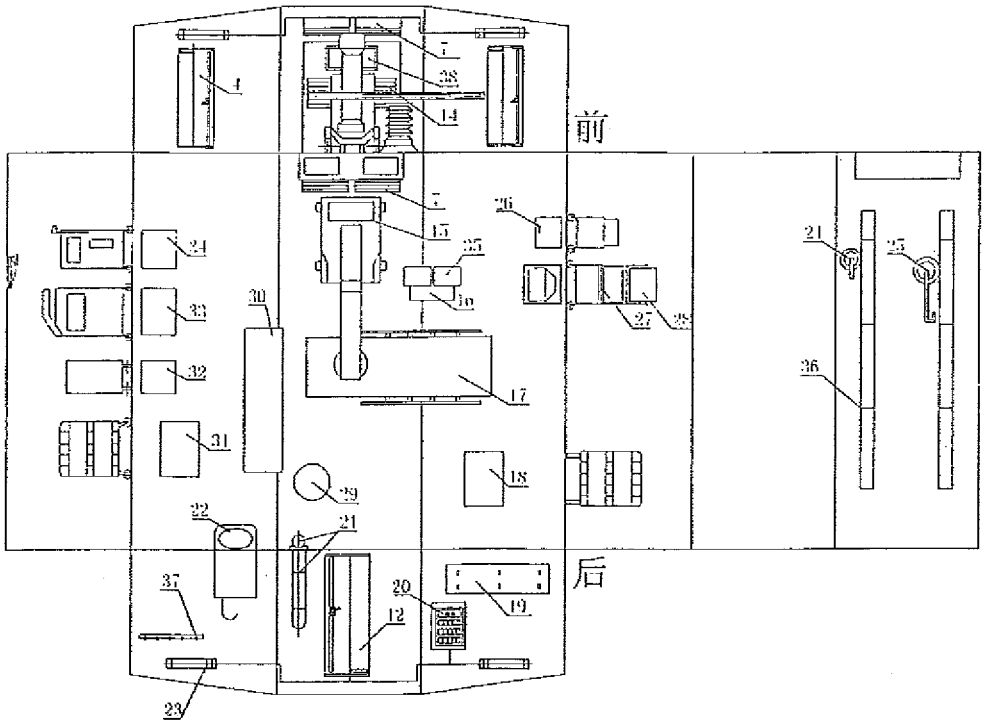
FIG. 3 is a cross-sectional view of the field emergency shelter when in working status according to an example embodiment of the present invention.

As shown in FIG. 3, in the fixed central shelter body, purifying air conditioners 7, TV 38, an apparatus box 14 are installed in the front part of the fixed central shelter body 1. A camera 24, a movable infusion support 25, and lamps 36 are installed on the ceiling of the fixed central shelter body 1. An electric power distribution box 20, an oxygen cylinder 21, and an instrument table holder 19 are installed on the rear part of the fixed central shelter body 1. A medium-sized C-arm X-ray apparatus 15, a monitor 16, an operating bed 17, a trash barrel 29 are installed in the middle part of the fixed central shelter body 1. Lamps 22 are installed in the extendable shelter body connected to the left side of the fixed central shelter body. A washbowl 22, a uniform hanger 37, a high-pressure syringe 33, an intra-aortic balloon pump 34, an oxygen generator 32, a small instrument table 31, and a large instrument table 30 are also installed in the extendable shelter body connected to the left side of the fixed central shelter body 1. A small instrument table 18, a constriction device 26, and an invasive blood pressure monitor 27, and a defibrillator monitor 28 are installed in the extendable shelter body connected to the right side of the fixed central shelter body 1.

Figure 4:
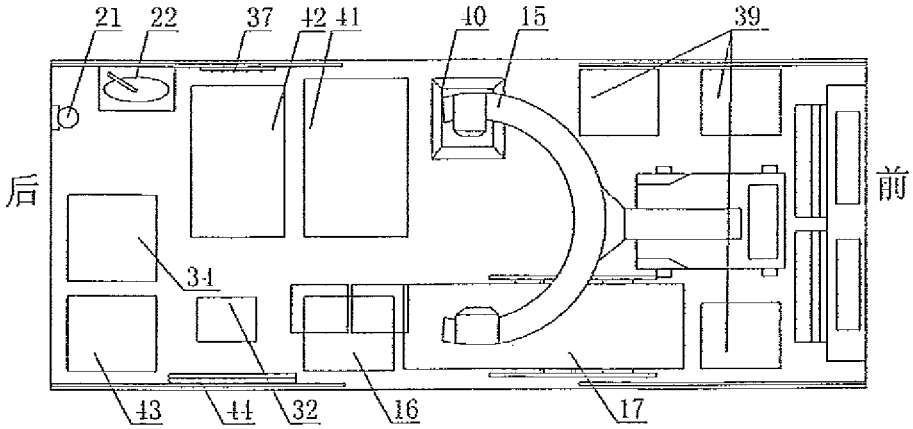
FIG. 4 is a cross-sectional view of the field emergency shelter when in normal status according to an example embodiment of the present invention.

As shown in FIG. 4, when the field emergency shelter for fast minimally invasive cardiovascular surgery is in normal status or transportation status, the two extendable shelter bodies are retracted back to the two sides of the fixed central shelter body 1 by the force generated by the hydraulic cylinder. Thus, the fixed central shelter body and the two extendable shelter bodies form a sealed integral body which is easy to be transported. When the field emergency shelter for fast minimally invasive cardiovascular is in normal status or transportation status, the medium-sized C-arm X ray apparatus is parallel to the floor of the fixed central shelter body 1. Two arms of the medium-sized C-arm X ray apparatus are disposed on the holder 40 and the operating bed 17, respectively. Three instrument boxes 39 are installed in the fixed central shelter body 1 close to the two sides of the C-arm X ray apparatus 15, respectively. The three instrument boxes are standard instrument boxes. An instrument box 41 and a high-pressure syringe box 42 are installed in the fixed central shelter body close to the rear side of the C-arm X ray apparatus 15. An intra-aortic balloon pump 34 and an instrument carrier 43 are installed in the fixed central shelter body close to the right rear side of the C-arm X ray apparatus 15. When the field emergency shelter for fast minimally invasive cardiovascular surgery is in working status, the invasive blood pressure monitor 27 and the defibrillator monitor 28 are disposed on the instrument carrier 43.

Figure 5:
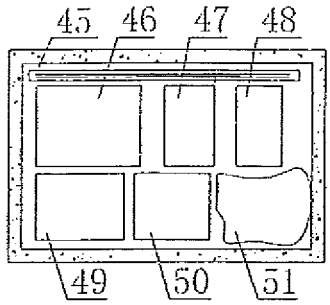
FIG. 5 is a cross-sectional view of an instrument box according to an example embodiment of the present invention.

As shown in FIG. 5, the instrument box 41 contains a medical tube 45, constriction devices 46 and 26, invasive blood pressure monitor 47 and 27, defibrillator monitors 48 and 28, a portable ultrasound device 49, an electrocardiographs 50, and lead cloth 51. These instruments are separately positioned and fixed in the instrument box by plastic foam.

Figure 6:
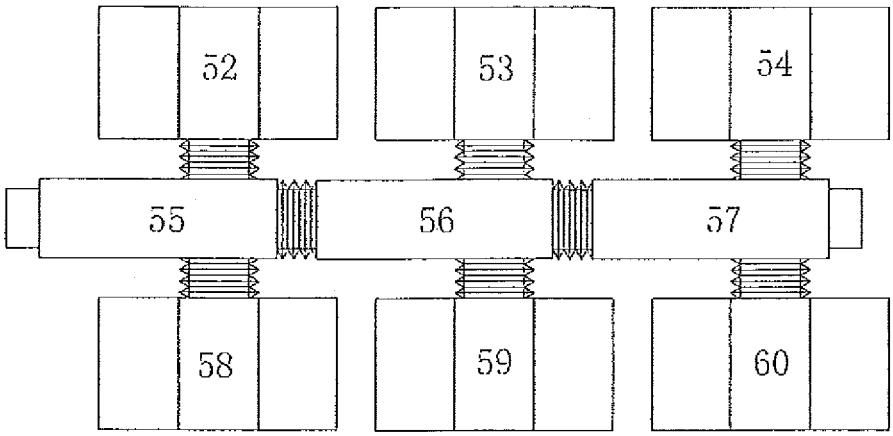
FIG. 6 is a top view of a battle field medical care support system according to example embodiments of the present invention.

As shown in FIG. 6, the field emergency shelter 60 is connected to a battle field medical care support system through the retractable linkage 13 (as shown in FIG. 2). The battle field medical care support system includes an emergency treatment shelter 52, a surgery shelter 53, a medical instrument-and-bacteria-killing shelter 54, transportation shelter 55, 56, 57, X-ray shelter 58, a surgery shelter 59, and a field emergency shelter 60.

The description above only illustrates specific embodiments and examples of the present disclosure. The present disclosure should therefore cover various modifications and variations made to the herein-described structure and operations of the present disclosure, provided they fall within the scope of the present invention as defined in the following appended claims.

What is claimed is:

1. A field emergency shelter for fast minimally invasive cardiovascular surgery, comprising:

a fixed central shelter body (1);

a poison filter (6), a purifying air conditioner (7), and a plurality of heating apparatus (8, 9) installed on the fixed central shelter body (1);

a door (12) installed on a side wall of the fixed central shelter body (1);

a tractable linkage (13) installed around the door (12);

two extendable shelter bodies (2) connected to the right side and left side of the fixed shelter body (1), respectively, wherein the two extendable shelter bodies (2) have an extendable structure;

a door (4) installed on a side wall of each of the extendable shelter bodies;

an apparatus box (14), a movable infusion support (25), an electric power distribution box (20), an oxygen cylinder (21), an instrument table holder (1), a C-arm X ray apparatus (15), a monitor (16) and an operating bed (17) installed in the fixed central shelter body, wherein the C-arm X-ray apparatus (15) is arranged on the front-middle portion of the fixed central shelter body (1);

a washbowl (22), a uniform hanger (37), a high-pressure syringe (33), an intra-aortic balloon pump (34), an oxygen generator (32), a small instrument table (31), and a large instrument table (30) installed in the two extendable shelter bodies;

a plurality of instrument boxes (39) installed in the fixed central shelter body (1) close to the base of the C-arm X-ray apparatus (15), respectively; and an instrument box (41) and a high-pressure syringe box (42) installed in the fixed central shelter body close to the C-arm portion of the C-arm X ray apparatus (15);

wherein each of the two extendable shelter bodies (2) has a hydraulic cylinder (3) and an extendable unit, and one working end of the hydraulic cylinder (3) is connected to one end of the extendable unit;

wherein, when in non-operation status, the operating bed (17) is arranged close to the base of the C-arm X-ray apparatus (15) with two long sides of the operating bed (17) being parallel to the side walls of the fixed central shelter body and meanwhile parallel to the base of the C-arm X-ray apparatus (15), the C-arm portion of the C-arm X-ray apparatus (15) is arranged to be parallel to the floor of the fixed central shelter body (1) with the two ends of the C-arm of the C-arm X ray apparatus (15) being fixed on the operating bed (17) and a holder (40), respectively;

wherein, when in operation status, the C-arm portion of the C-arm X-ray apparatus is arranged to be perpendicular to the floor of the fixed central shelter body (1) and the operating bed (17) is rotated by a 90 degree angle and is thus perpendicular to both the base and the C-arm portion of the C-arm X-ray apparatus such that the operating bed (17) can be inserted into the C-arm portion of the C-arm X-ray apparatus.

2. The field emergency shelter for fast minimally invasive cardiovascular surgery according to claim 1, further comprising a sun-proof rack (11) installed on the roof of the fixed central shelter body (1).

3. The field emergency shelter for fast minimally invasive cardiovascular surgery according to claim 2, wherein the instrument box 41 contains a medical tube 45, a plurality of constriction devices 46, 26, a plurality of invasive blood pressure monitor 47, 27, a plurality of defibrillator monitors 48, 28, a portable ultrasound device 49, an electrocardiographs 50, and a lead cloth 51.

* * * * *